US005386749A

United States Patent [19]

Kim

[11] Patent Number: 5,386,749

[45] Date of Patent: Feb. 7, 1995

[54] SOCKET FOR WRENCH

[76] Inventor: Kwang-Moo Kim, 755-3, Kyomoon-Dong, Koori, Kyunggi-Do, Rep. of Korea

[21] Appl. No.: 92,526

[22] Filed: Jul. 16, 1993

[30] Foreign Application Priority Data

| | | | |
|---|---|---|---|
| Jan. 12, 1993 | [KR] | Rep. of Korea | 93-349 |
| Feb. 13, 1993 | [KR] | Rep. of Korea | 93-1948 |
| Mar. 10, 1993 | [KR] | Rep. of Korea | 93-3486 |
| May 29, 1993 | [KR] | Rep. of Korea | 93-9190 |

[51] Int. Cl.[6] ..... B25B 13/58

[52] U.S. Cl. ..... 81/185; 81/179; 81/DIG. 11

[58] Field of Search ..... 81/179, 185, DIG. 11

[56] References Cited

U.S. PATENT DOCUMENTS 3,738,203 6/1973 Cudd ..... 81/185

FOREIGN PATENT DOCUMENTS 166506 8/1950 Austria ..... 81/185

*Primary Examiner*—James G. Smith

*Attorney, Agent, or Firm*—Birch, Stewart, Kolasch & Birch

[57] ABSTRACT

A socket for a socket wrench comprising a socket body having a socket cavity formed at a lower portion of the socket body to extend vertically and a through hole, a pair of facing half sockets with different sizes fitted in the socket cavity to slide vertically, and an adjusting mechanism provided at an upper portion of the socket body and adapted to selectively adjust the vertical slide movements of the half sockets. The adjusting mechanism includes an adjusting member having an upper rod portion inserted into the through hole of the socket body such that its upper end is outwardly protruded from the through hole and a lower adjusting portion having a lower end of a long oval shape, a compression coil spring fitted around the upper rod portion and adapted to urge the adjusting member downward, and an adjusting knob including a coupling hole for forcedly fitting the protruded upper end of the upper rod portion of the adjusting member therein and a lug formed at a lower surface of the adjusting knob and adapted to temporarily fix the position of the adjusting member.

12 Claims, 12 Drawing Sheets

SOCKET FOR WRENCH

BACKGROUND OF THE INVENTION

1. Field of the Invention

The present invention relates to a socket-type wrench, and more particularly to a socket for such a socket wrench including a pair of half sockets with different sizes, capable of being used for fastening and loosening various bolts and nuts with different sizes.

2. Description of the Prior Art

Conventional socket wrenches and sockets therefore have been disclosed in U.S. Pat. Nos. 5,074,174 and 5,140,875 issued to the present inventor. In these cases, a plurality of socket units with different sizes are disposed in a wrench body. Otherwise, a lower socket equipped with a plurality of socket units with different sizes is coupled to the wrench body. Since these socket units should have a sufficient strength due to the constructional characteristics of the socket wrenches, the socket units can not have a reduced thickness. Due to such a limitation on reducing the thickness, the variety of socket units may be limited, so that the socket units may not mate with specific sizes of bolts or nuts. As a result, the conventional sockets have a disadvantage that various sizes of bolts and nuts can not be handled thereby.

In the construction with upper and lower sockets coupled to each other, there is also a disadvantage that the overall size is bulky.

Other socket wrenches and sockets therefore also have been disclosed in U.S. Pat. Nos. 4,663,999 and 4,781,084. In these cases, however, the overall construction is complex, thereby causing the fabrication of constituting elements to be difficult. Furthermore, a troublesome and difficult assembling work which increases the manufacture cost is required.

Particularly, the socket proposed in U.S. Pat. No. 4,781,084 has a limited utility as general tools, because it is mainly used for oil filters.

SUMMARY OF THE INVENTION

Therefore, an object of the invention is to eliminate the above-mentioned disadvantages involved in the prior art and thus to provide a socket for a socket wrench which is capable of handling various sizes of bolts and nuts and is simple in construction and thus easy to manufacture.

Another object of the invention is to provide a socket for a socket wrench which is easy to manufacture and assemble constituting elements, thereby enabling a mass production.

In accordance with the present invention, these objects can be accomplished by providing a socket for a socket wrench comprising: a socket body; a socket cavity formed at a lower portion of said socket body to extend vertically; a pair of facing half sockets with different sizes fitted in said socket cavity to slide vertically; and an adjusting mechanism provided at an upper portion of the socket body and adapted to selectively adjust the vertical slide movements of said half sockets.

BRIEF DESCRIPTION OF THE DRAWINGS

Other objects and aspects of the invention will become apparent from the following description of embodiments with reference to the accompanying drawings in which:

FIGS. 13 to 20 show various operation conditions of the socket according to the embodiment illustrated in FIGS. 1 to 3, wherein FIGS. 13, 15, 17 and 19 are cross-sectional views taken along the line A—A of FIG. 2, and FIGS. 14, 16, 18 and 20 are cross-sectional views taken along the line B—B of FIG. 2; and FIGS. 21 to 28 show various operation conditions of the socket according to the embodiment illustrated in FIGS. 7 to 9, wherein FIGS. 21, 23, 25 and 27 are cross-sectional views taken along the line C—C of FIG. 8, and FIGS. 22, 24, 26 and 28 are cross-sectional views taken along the line D—D of FIG. 8.

DETAILED DESCRIPTION OF THE PREFERRED EMBODIMENTS

Figure 1:
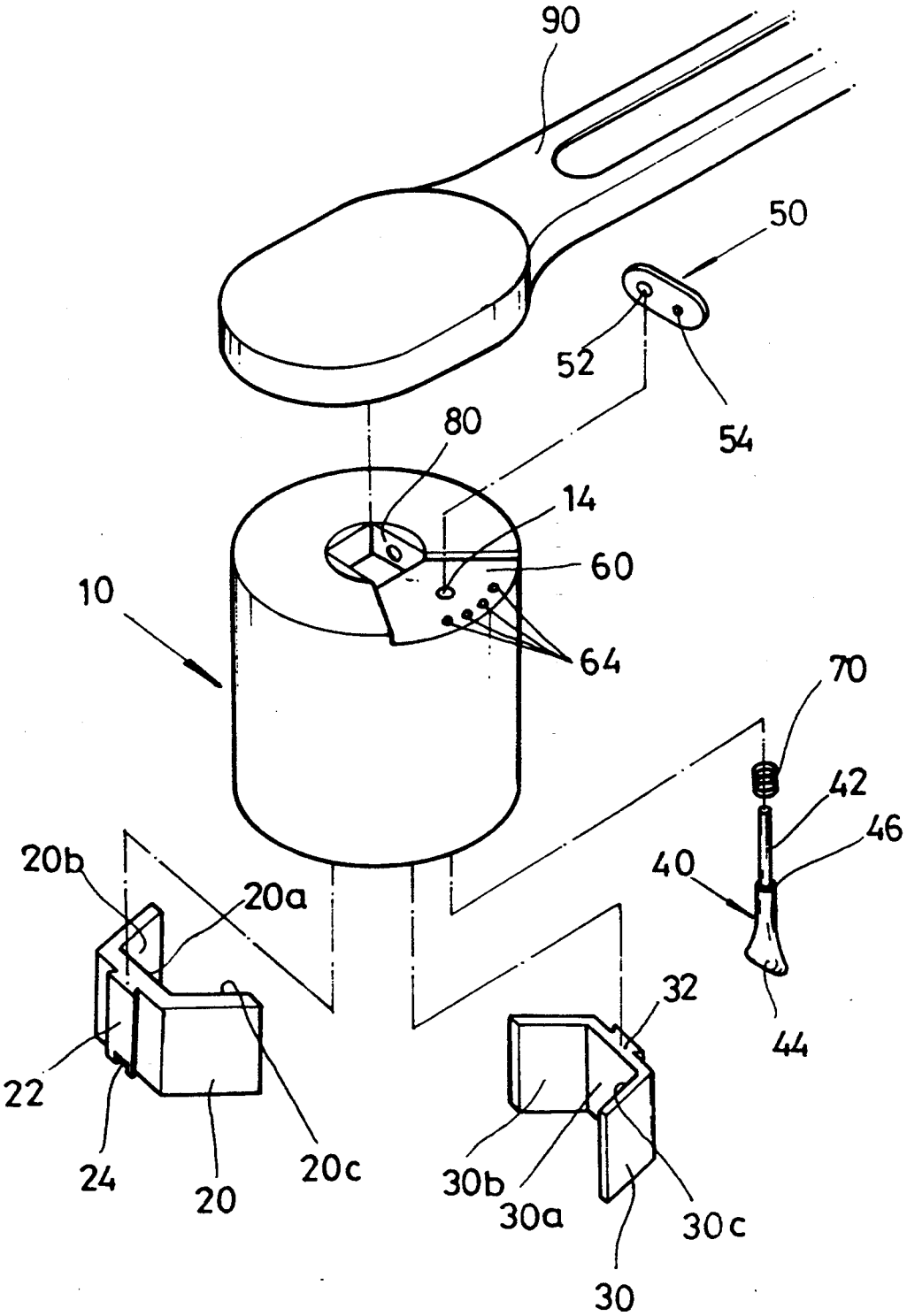
FIG. 1 is an exploded perspective view of a socket for a socket wrench in accordance with an embodiment of the present invention.
Figure 2:
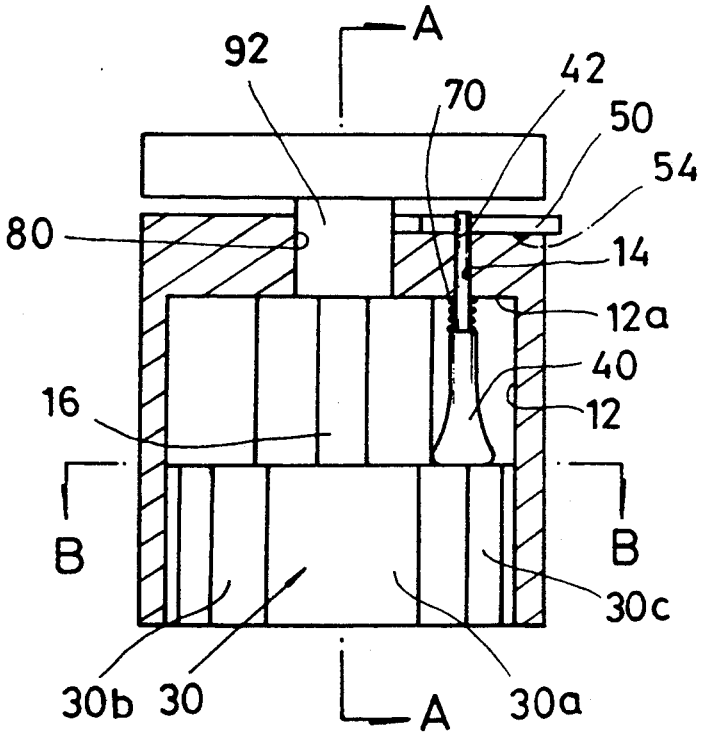
FIG. 2 is a sectional view of the socket of FIG. 1, showing the assembled condition thereof.
Figure 3:
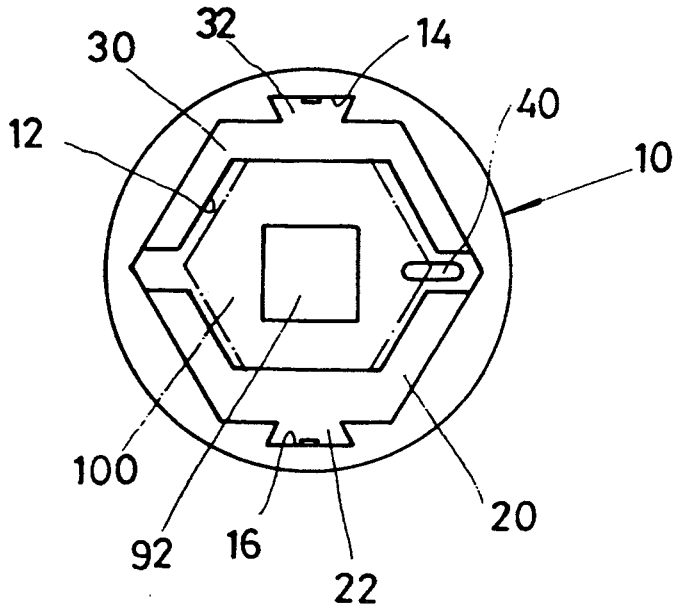
FIG. 3 is a bottom view of the socket shown in FIG. 2.

Referring to FIGS. 1 to 3, there is illustrated a socket for a socket wrench in accordance with an embodiment of the present invention. As shown in FIGS. 1 to 3, the socket comprises a socket body 10 having at its lower portion a deep socket cavity 12 extending vertically and defining the interior of socket body 10. In the socket cavity 12, a pair of half sockets 20 and 30 with different sizes are fitted such that they face each other. At one side of the upper portion of socket body 10, an adjusting member 40 constituting a part of an adjusting mechanism is disposed in the upper portion of socket cavity 12. The adjusting member 40 extends through a through hole 14 perforated into the upper portion of socket body 10 so that its upper end is outwardly protruded from the through hole 14. An adjusting knob 50 which constitutes a part of the adjusting mechanism is coupled to the protruded upper end of adjusting member 40.

The socket cavity 12 has a pair of slide grooves 16 and 16', whereas the half sockets 20 and 30 have at their outer surfaces slide protrusions 22 and 32 which are engaged in the slide grooves 16 and 16', respectively. With such a construction, the half sockets 20 and 30 can slide vertically along the slide grooves 16 and 16', respectively.

The half sockets 20 and 30 are provided at their lower ends with notches 24 and 34, respectively. On the other hand, the socket body 10 is provided with a pair of stop lugs 18 and 19 at positions where the notches 24 and 34 are positioned when the half sockets 20 and 30 are coupled to the socket body 10, respectively. The stop lugs 18 and 19 are engaged in the notches 24 and 34, respectively, so that the half sockets 20 and 30 are prevented from separating downwards away from the socket body 10.

The half socket 20 has a central portion 20*a* and a pair of opposite side end portions 20*b* and 20*c* extending angularly from respective ends of the central portion 20*a*. The central portion 20*a* has a thickness larger than those of the side end portions 20*b* and 20*c*. In similar, the half socket 30 has a central portion 30*a* and a pair of opposite side end portions 30*b* and 30*c* extending angularly from respective ends of the central portion 20*a*. The central portion 30*a* has a thickness larger than those of the side end portions 30*b* and 30*c*. With such constructions, they can be conveniently used by fitting a bolt or a nut with a proper size therein, in use.

Each of one side end portions 20*c* and 30*c* of half sockets 20 and 30 has a width larger than that of each corresponding one of the other side end portions 20*b* and 30*b* so that the gap defined between one side end portions 20*c* and 30*c* is larger than the gap defined between the other side end portions 20*b* and 30*b*, thereby avoiding the adjusting member 40 from interfering therewith.

A recess 60 is provided at one side portion of the upper surface of socket body 10. The recess 60 is connected with the through hole 14 and provided with a plurality of index depressions 64.

The adjusting member 40 has an upper rod portion 42 and a lower adjusting portion 44 having a lower end of a long oval shape. A step 46 is formed between the upper rod portion 42 and the lower adjusting portion 44.

The adjusting knob 50 has a coupling hole 52 for forcedly fitting the protruded upper end of the upper rod portion 42 of adjusting member 40 therein. Formed at the lower surface of adjusting knob 50 is a lug 54 engagable in a selected one of the index depressions 64. For coupling the adjusting knob 50 to the adjusting member 40, first, the upper rod portion 42 of adjusting member 40 is inserted into the through hole 14 from the socket cavity 12 of socket body 10 until its upper end is outwardly protruded from the through hole 14, under a condition that a compression coil spring 70 is fitted around the upper rod portion 42. Then, the protruded upper end of upper rod portion 42 fits forcedly in the coupling hole 52 of adjusting knob 50.

At this time, the spring 70 is supported between the step 46 of adjusting member 40 and the upper surface 12*a* of socket cavity 12 while being maintained under a compressed condition, so that it always urges the adjusting knob 50 downwards, thereby enabling the lug 54 to be resiliently engaged in the selected index depression 64. With such constructions, as the adjusting knob 50 is rotated about the upper rod portion 42 of adjusting member 40 in a clockwise or counterclockwise direction while slightly pulling it up against the force of compression coil spring 70, the adjusting member 40 can be rotated so that the position of the lower adjusting portion 44 can be adjusted. The adjusted position of lower adjusting portion 44 can be temporarily fixed, by engaging the lug 54 in the selected index depression 64.

In the figures, the reference numeral 80 designates a coupling recess formed centrally at the upper portion of socket body 10 and adapted to fit a coupling portion 92 of a wrench handle 90 conventionally used, therein.

Figure 4:
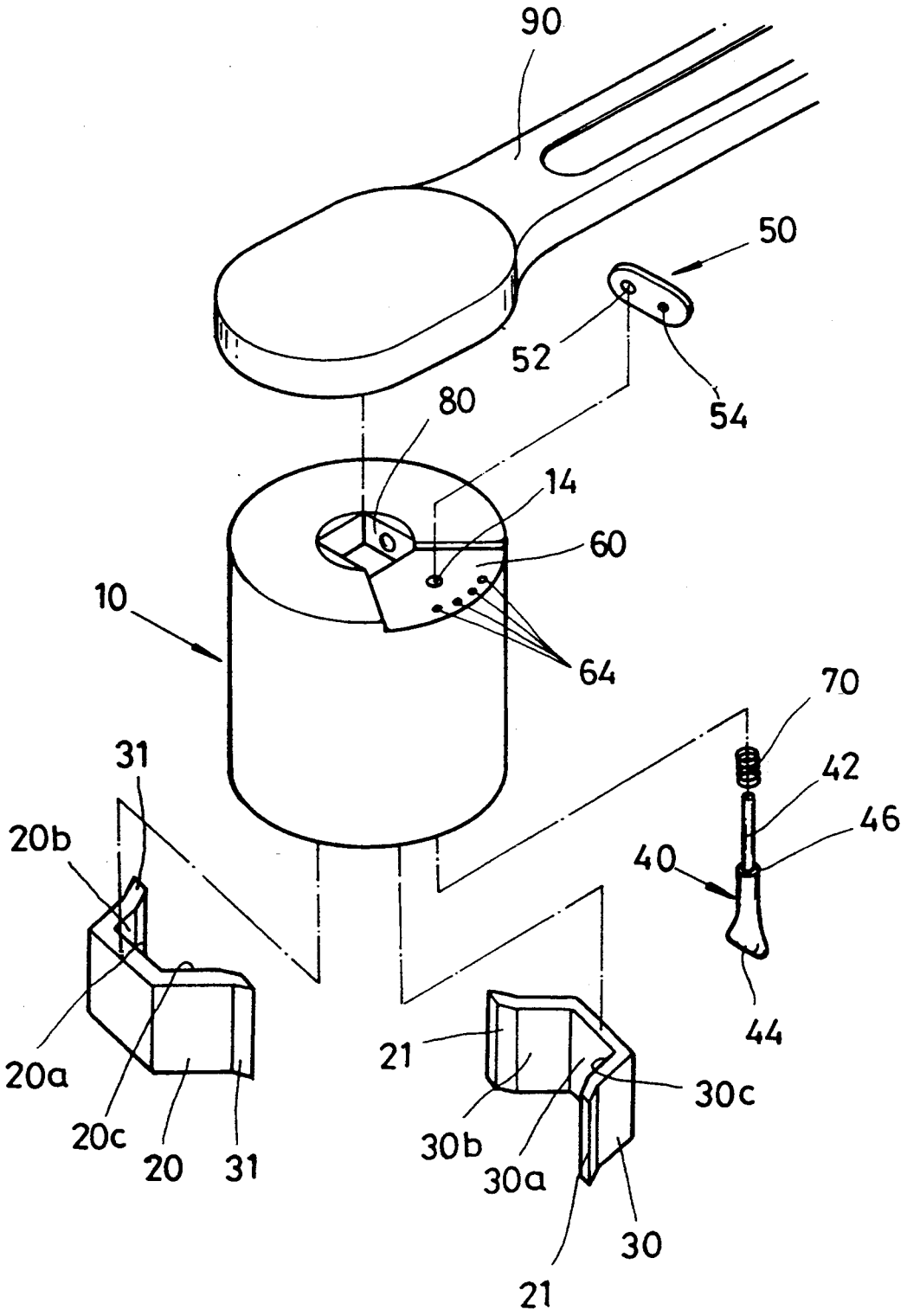
FIG. 4 is an exploded perspective view of a socket in accordance with another embodiment of the present invention.
Figure 5:
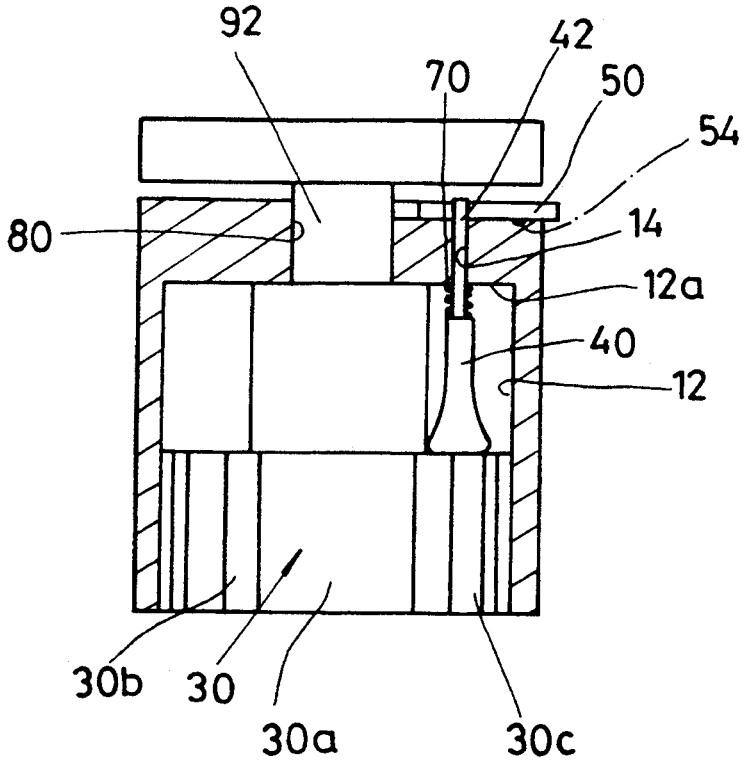
FIG. 5 is a sectional view of the socket of FIG. 4, showing the assembled condition thereof.
Figure 6:
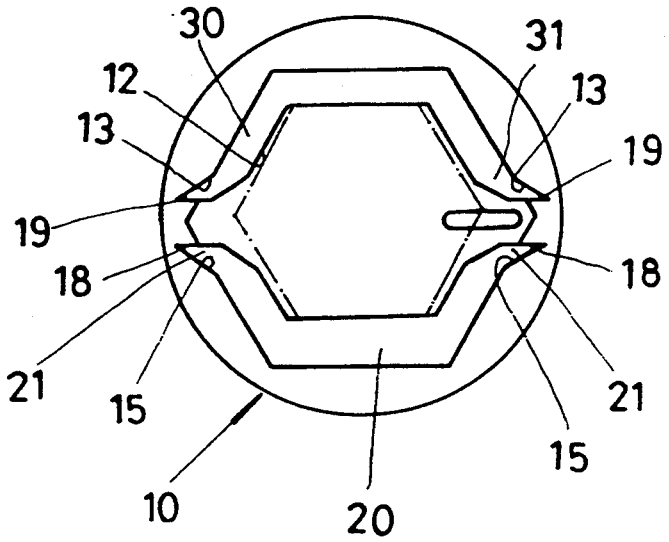
FIG. 6 is a bottom view of the socket shown in FIG. 5.

Referring to FIGS. 4 to 6, there is illustrated a socket in accordance with another embodiment. In this case, the socket has a similar construction to those of the above-mentioned embodiment illustrated in FIGS. 1 to 3, except for construction of the socket cavity 12 and the half sockets 20 and 30. In FIGS. 4 to 6, the constituting elements similar or identical to those of FIGS. 1 to 3 are designated by the same reference numerals.

In accordance with this embodiment, the socket cavity 12 has a pair of first slide grooves 13 and a pair of second slide grooves 15, whereas the half sockets 20 and 30 have at their opposite side ends outer slide protrusions 21 and 31 which are engaged in the second slide grooves 15 and the first slide grooves 13, respectively. With such a construction, the outer slide protrusions 21 and 31 of half sockets 20 and 30 can slide vertically along the second slide grooves 15 and the first slide grooves 13, respectively.

After fitting the half sockets 20 and 30 in the socket cavity 12, the socket body 10 is formed with a pair of stop lugs 18 and 19 at its lower surface portions where the slide grooves 13 and 15 are positioned, in a punching manner, so that the half sockets 20 and 30 are prevented from separating downwards from the socket body 10.

Figure 7:
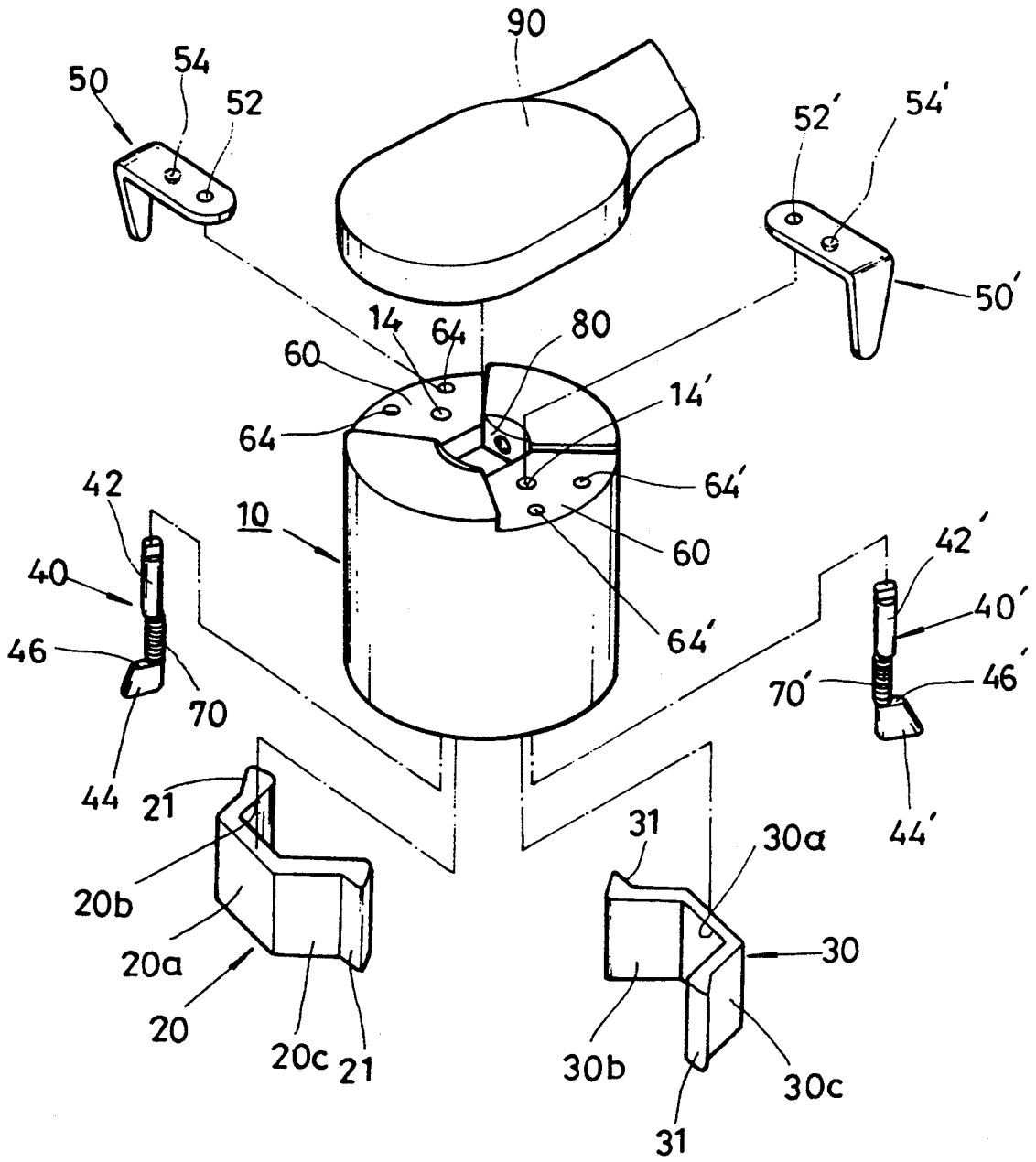
FIG. 7 is an exploded perspective view of a socket in accordance with another embodiment of the present invention.
Figure 8:
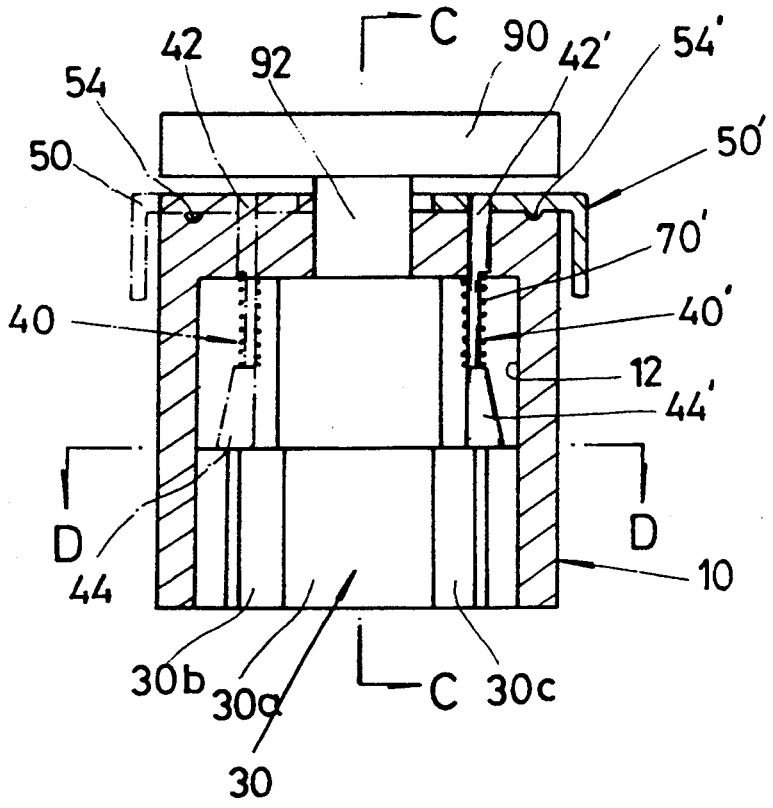
FIG. 8 is a sectional view of the socket of FIG. 7, showing the assembled condition thereof.
Figure 9:
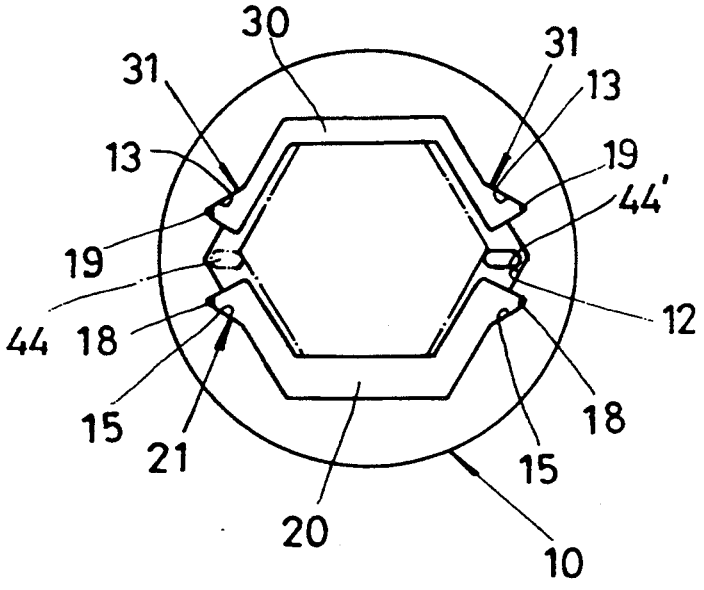
FIG. 9 is a bottom view of the socket shown in FIG. 8.

Referring to FIGS. 7 to 9, there is illustrated a socket in accordance with another embodiment. In this case, the socket has a similar construction to those of the above-mentioned embodiment illustrated in FIGS. 4 to 6 with respect to the socket cavity 12 of socket body 10 and half sockets 20 and 30, except that a pair of adjusting mechanisms constituted by respective ones of adjusting members 40 and 40' and respective ones of adjusting knobs 50 and 50' are provided. In FIGS. 7 to 9, the constituting elements similar or identical to those of FIGS. 4 to 6 are designated by the same reference numerals.

In accordance with this embodiment, a pair of recesses 60 and 60' are provided at opposite side portions of the upper surface of socket body 10. The recess 60 has a through-hole 14 and a plurality of index depressions 64. Also, the recess 60' has a through-hole 14' and a plurality of index depressions 64'.

The adjusting members 40 and 40' have respective upper rod portions 42 and 42' and respective lower adjusting portions 44 and 44' each having a lower end of a long oval shape. Steps 46 and 46' are formed at respective upper ends of the lower adjusting portions 44 and 44'.

The adjusting knobs 50 and 50' are constructed to be of a 90°-bent shape and have respective coupling holes 52 and 52' for forcedly fitting respective protruded upper ends of the upper rod portions 42 and 42' of adjusting members 40 and 40' therein. Formed at respective lower surfaces of adjusting knobs 50 and 50' are a pair of lugs 54 and 54' engagable in respective selected ones of the index depressions 64 and 64'. For coupling the adjusting knobs 50 and 50' to the adjusting members 40 and 40' respectively, first, the upper rod portions 42 and 42' of adjusting members 40 and 40' are inserted into the through-holes 14 and 14' from the socket cavity 12 of socket body 10 until their upper ends are outwardly protruded from the through-holes 14 and 14', under a condition that compression coil springs 70 and 70' are fitted around the upper rod portions 42 and 42', respectively. Then, the protruded upper ends of upper rod portions 42 and 42' fit forcedly in the coupling holes 52 and 52' of adjusting knobs 50 and 50', respectively.

At this time, the springs 70 and 70'are supported between respective steps 46 and 46' of adjusting members 40 and 40' and the upper surface 12*a* of socket cavity 12 while being maintained under a compressed condition, so that they always urge the adjusting knobs 50 and 50' downwards, thereby enabling the lugs 54 and 54' to be resiliently engaged in the selected index depressions 64 and 64', respectively. With such construction, as the adjusting knobs 50 and 50' are rotated about the upper rod portions 42 and 42' of adjusting members 40 and 40' clockwise or counterclockwise while slightly pulling them up against the forces of compression coil springs 70 and 70', the adjusting members 40 and 40' can be rotated so that the positions of lower adjusting portions 44 and 44' can be adjusted, respectively. The adjusted positions of lower adjusting portions 44 and 44' can be temporarily fixed, by engaging the lug 54 and 54' in the selected index depressions 64 and 64', respectively.

Figure 10:
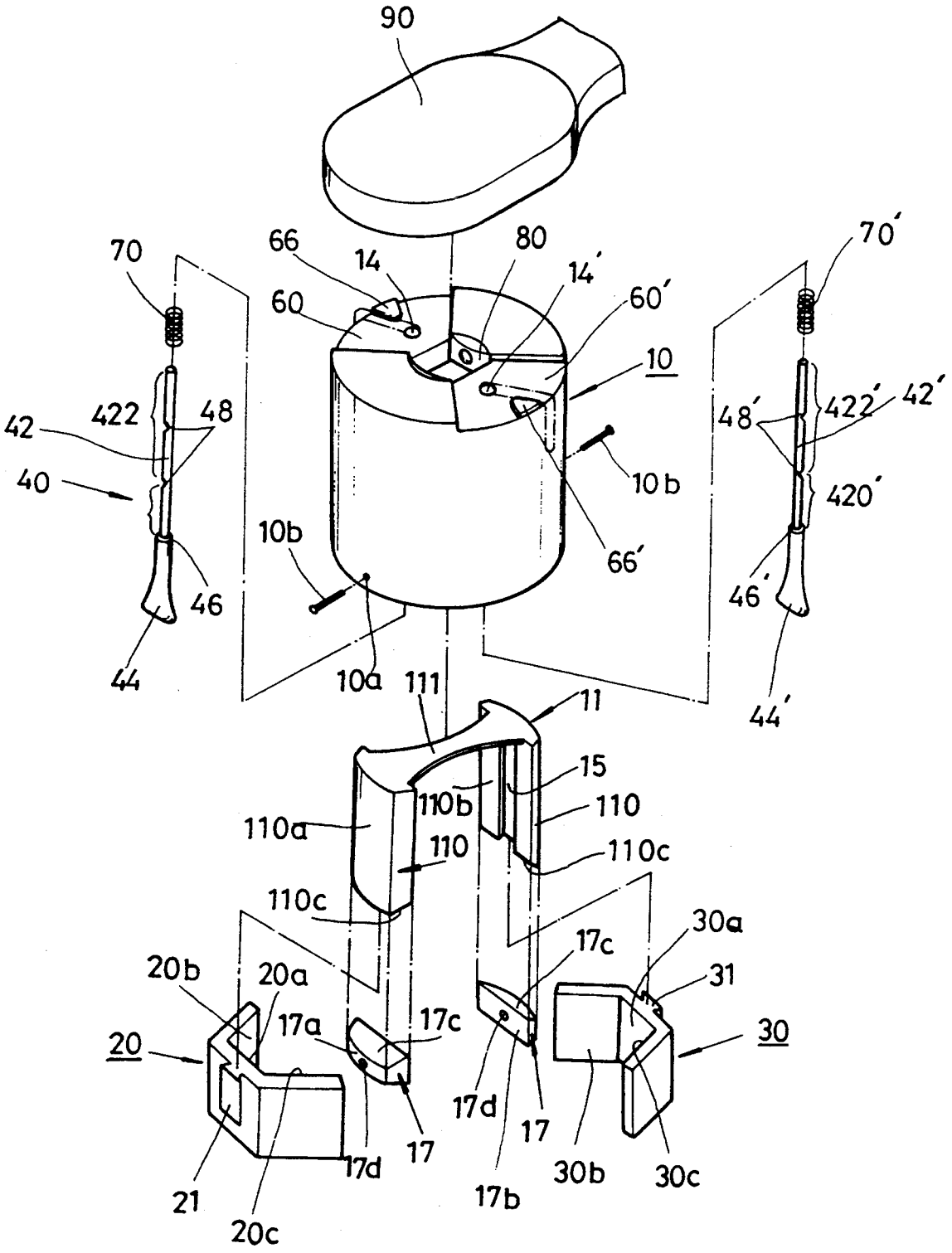
FIG. 10 is an exploded perspective view of a socket in accordance with another embodiment of the present invention.
Figure 11:
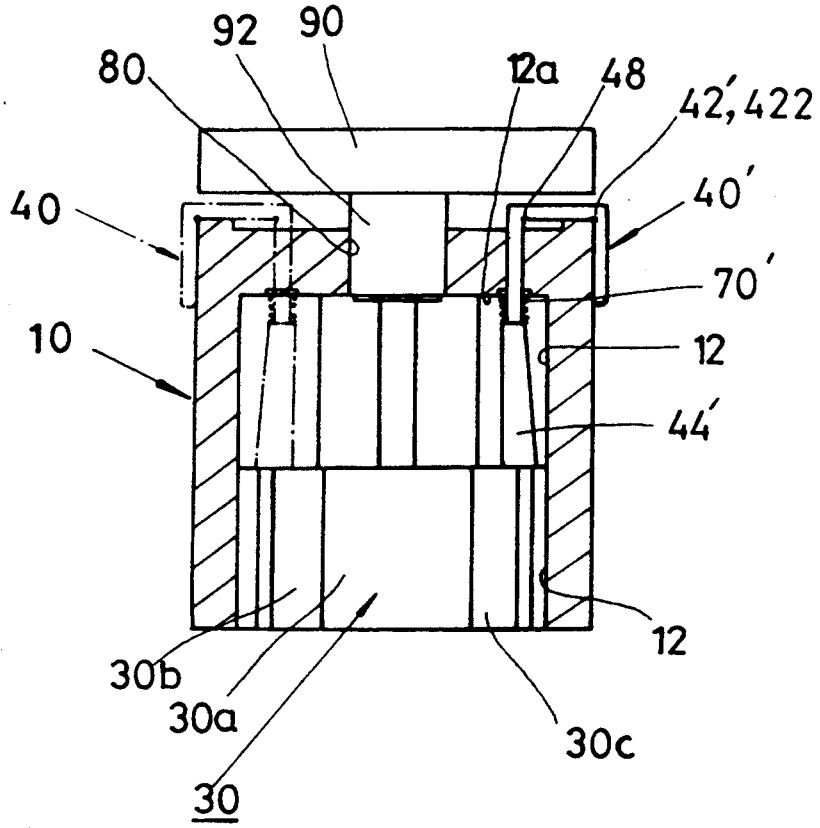
FIG. 11 is a sectional view of the socket of FIG. 10, showing the assembled condition thereof.
Figure 12:
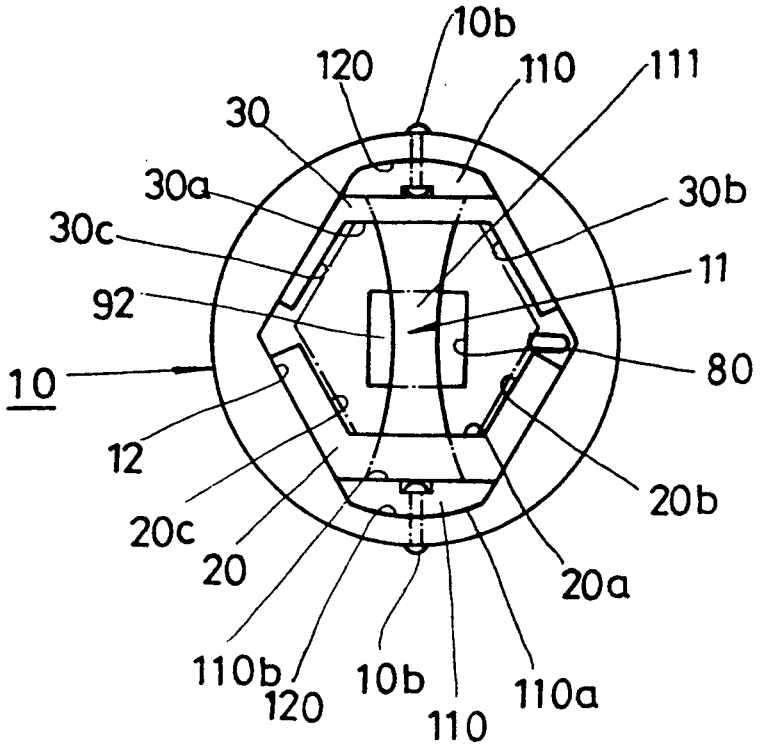
FIG. 12 is a bottom view of the socket shown in FIG. 11.

Referring to FIGS. 10 to 12, there is illustrated a socket in accordance with another embodiment. In this case, the socket has a similar construction to those of the above-mentioned embodiment illustrated in FIGS. 1 to 3 with respect to the socket cavity 12 of socket body 10 and half sockets 20 and 30 and to those of the above-mentioned embodiment illustrated in FIGS. 7 to 9 with respect to the adjusting members 40 and 40' of adjusting mechanisms. In FIGS. 10 to 12, the constituting elements similar or identical to those of FIGS. 1 to 9 are designated by the same reference numerals.

In accordance with this embodiment, a slide fixing member 11 is fitted in the socket cavity 12. The adjusting members 40 and 40' are inserted into the through-holes 14 and 14' of the socket body 10 and held in position in a bending manner.

The socket cavity 12 has a pair of opposite arc grooves 120 facing each other. Between the grooves 120, the slide fixing member 11 is fitted in the socket cavity 12. The slide fixing member 11 has a pair of facing slide grooves 13 and 15, whereas the half sockets 20 and 30 have at their outer surfaces outer slide protrusions 21 and 31 which are engaged in the slide grooves 13 and 15, respectively. Beneath the slide fixing member 11, a pair of fixing end members 17 are fitted in respective grooves 120 of socket cavity 12 and coupled to the socket body 10. With such a construction, the outer slide protrusions 21 and 31 of half sockets 20 and 30 can slide vertically along the slide grooves 13 and 15, respectively.

In particular, the slide fixing member 11 has a pair of spaced vertical portions 110 and a horizontal connecting portion 111 connecting the vertical portions 110 to each other. Each vertical portion 110 of slide fixing member 11 has an outer arc surface 110*a* corresponding to each arc groove 120 of the socket cavity 12, an inner flat surface 110*b* provided with a corresponding one of the slide grooves 13 and 15, and a lower tapered surface 110*c*.

Each fixing member 17 has an outer arc surface 17*a* and an inner flat surface 17*b*. Each fixing member 17 is also provided at its upper surface with a tapered surface 17*c* engaged with each corresponding lower tapered surface 110*c* of the slide fixing member 11. At the middle portion thereof, the fixing member 17 has a through-hole 17*d*. In assembling, the through-hole 17*d* of each fixing member 17 is aligned with a corresponding one of through-holes 10*a* formed at the socket body 10, so that a fixture such as a rivet is inserted into the aligned through-holes 10*a* and 17*d*, for fixing the fixing member 17 to the socket body 10.

Of course, the grooves 120 may be formed to have an outer flat surface. In this case, the outer surfaces 110*a* of slide fixing member 11 and the outer surfaces 17*a* of fixing members 17 are formed to have a flat shape.

In accordance with this embodiment, a pair of recesses 60 and 60' are also provided at opposite side portions of the upper surface of socket body 10. The recesses 60 and 60' have respective of through-holes 14 and 14' and respective index protrusions 66 and 66'. The adjusting members 40 and 40' have respective upper rod portions 42 and 42' and respective lower adjusting portions 44 and 44' each having a lower end of a long oval shape. Steps 46 and 46' are formed between respective ones of the upper rod portions 42 and 42' and respective ones of the lower adjusting portions 44 and 44'. The upper rod portion 42 has a pair of spaced small grooves 48 which are adapted to bend the upper rod portion 42 such that the upper rod portion 42 is divided into a lower coupling part 420 and an upper handle part 422. Also, the upper rod portion 42' has a pair of spaced small grooves 48' which are adapted to bend the upper rod portion 42' such that the upper rod portion 42' is divided into a lower coupling part 420' and an upper handle part 422'. For coupling the adjusting members 40 and 40' to the socket body 10, first, the upper rod portions 42 and 42' of adjusting members 40 and 40' are inserted into the through-holes 14 and 14' from the socket cavity 12 of socket body 10 until their upper handle parts 422 and 422' are outwardly protruded from the through-holes 14 and 14', under a condition that compression coil springs 70 and 70' are fitted around the lower coupling parts 420 and 420', respectively. Then, the protruded upper handle parts 422 and 422' are bent at the small grooves 48 and 48', respectively, so as to serve as handles.

At this time, the springs 70 and 70' are supported between respective steps 46 and 46' of adjusting members 40 and 40' and the upper surface 12*a* of socket cavity 12 while being maintained under a compressed condition, so that they always urge the upper handle parts 422 and 422' of adjusting members 40 and 40' downwards, respectively, thereby enabling the upper handle part 422 and 422' to be in resilient contact with the outer surface of socket body 10. With such a construction, as the upper handle parts 422 and 422' of adjusting members 40 and 40' are rotated about respective through-holes 14 and 14' in a clockwise or counterclockwise direction while slightly pulling them up, they can move across the index protrusions 66 and 66' to be seated at selected ones of opposite sides of the index protrusions 66 and 66', together with the lower adjusting portions 44 and 44', respectively.

In the figures, the reference numeral 100 designates a head of a bolt or nut.

Now, operations of the above-mentioned embodiments according to the present invention will be described.

As mentioned above, both the embodiments illustrated in FIGS. 1 to 3 and FIGS. 4 to 6 are constructed to include a single adjusting mechanism. Accordingly, the following description will be made only for the embodiment of FIGS. 1 to 3, in conjunction with FIGS. 13 to 20 illustrating various operation conditions.

Figure 13:
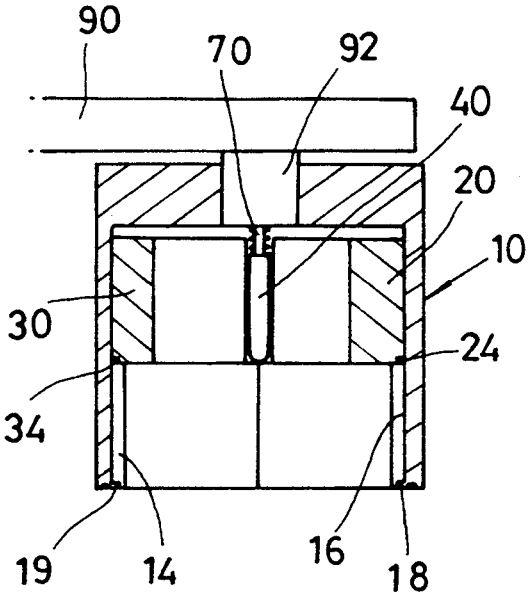
Figure 14:
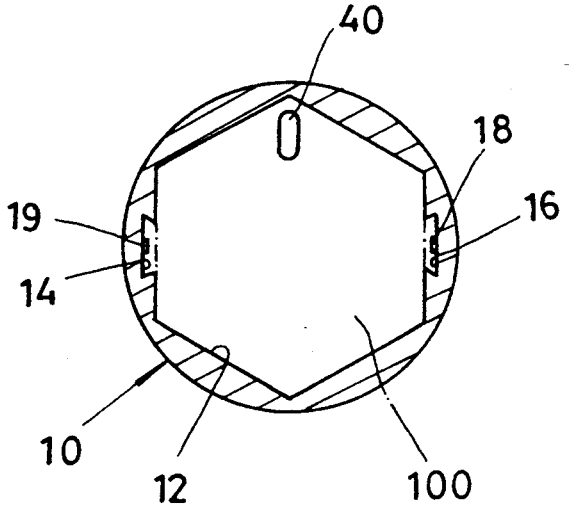

The condition of FIGS. 13 and 14 corresponds to a case where the lower adjusting portion 44 of adjusting member 40 is disposed in the gap defined between one side end portions 20*c* and 30*c* of the half sockets 20 and 30. In this case, the half sockets 20 and 30 can move upwards in the socket cavity 12. Accordingly, where a bolt or nut with the largest size is inserted into the socket cavity 12, the half sockets 20 and 30 are upwardly lifted in the socket cavity 12 by the bolt or nut being inserted, so that the bolt or nut can be fitted in the socket cavity 12, to utilize the function of a socket wrench.

Figure 15:
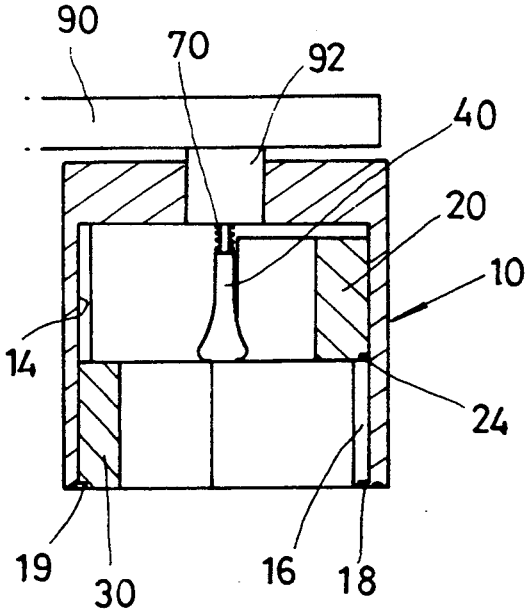
Figure 16:
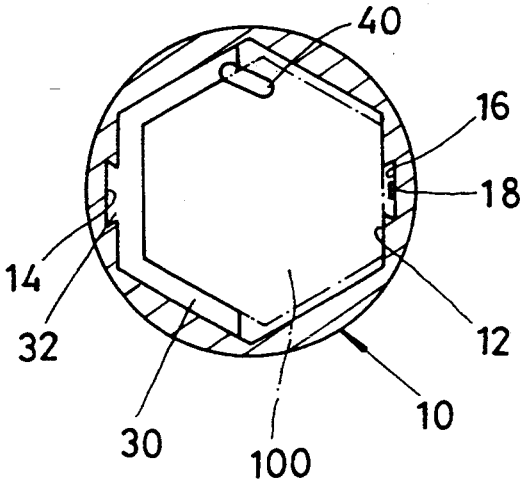
Figure 17:
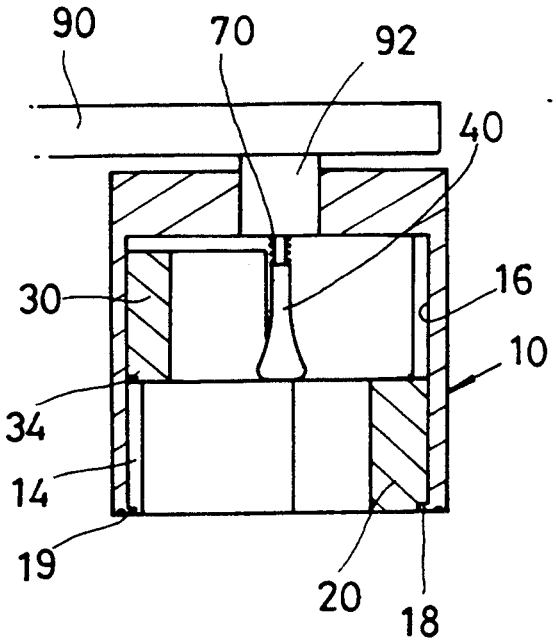

FIGS. 15 and 16 illustrate a condition that the lower adjusting portion 44 of adjusting member 40 is adjusted to be partially disposed over the half socket 30, by an adjustment of the adjusting knob 50. In this case, only the half socket 20 can move upwards in the socket cavity 12. Accordingly, this case can be applied to a bolt or nut with a size smaller than that of FIGS. 13 and 14. The bolt or nut comes into contact with the inner surface of half socket 30 and the side surface portion of socket cavity 12 facing the inner surface of half socket 30, to utilize the function of the socket wrench.

Contrary to the condition of FIGS. 15 and 16, FIGS. 17 and 18 illustrate a condition that the lower adjusting portion 44 of adjusting member 40 is adjusted to be partially disposed over the half socket 20, by the adjustment of the adjusting knob 50. In this case, only the half socket 30 can move upwards in the socket cavity 12. Accordingly, this case can be applied to a bolt or nut with a size smaller than that of FIGS. 15 and 16. The bolt or nut comes into contact with the inner surface of half socket 30 and the side surface portion of socket cavity 12 facing the inner surface of half socket 20, to utilize the function of a socket wrench.

Figure 19:
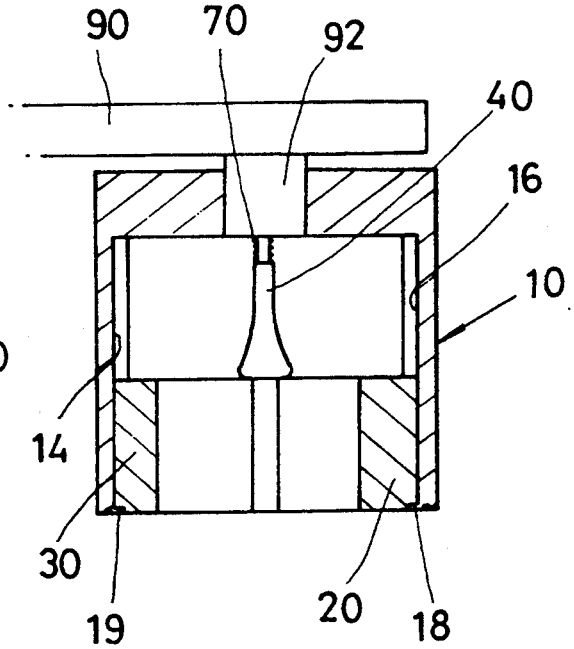
Figure 18:
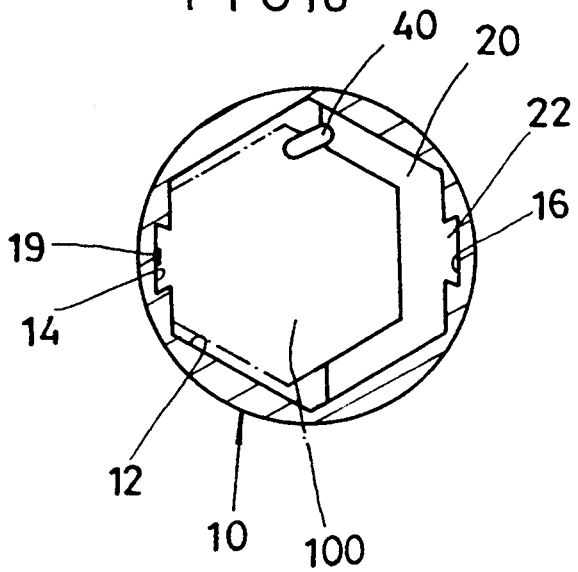
Figure 20:
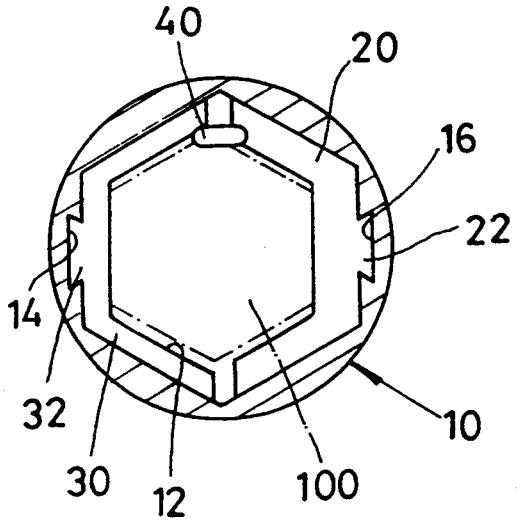

The condition of FIGS. 19 and 20 corresponds to a case where the lower adjusting portion 44 of adjusting member 40 is adjusted to be partially disposed over both the half sockets 20 and 30, by the adjustment of the adjusting knob 50. In this case, both the half sockets 20 and 30 can not move upwards in the socket cavity 12. Accordingly, this case can be applied to a bolt or nut with a size smaller than that of FIGS. 17 and 18. The bolt or nut comes into contact with both the inner surfaces of half sockets 20 and 30, to utilize the function of a socket wrench.

As mentioned above, both the embodiments illustrated in FIGS. 7 to 9 and FIGS. 10 to 12 are constructed to include a double adjusting mechanism. Accordingly, the following description will be made only for the embodiment of FIGS. 7 to 9, in conjunction with FIGS. 21 to 28 illustrating various operation conditions.

Figure 21:
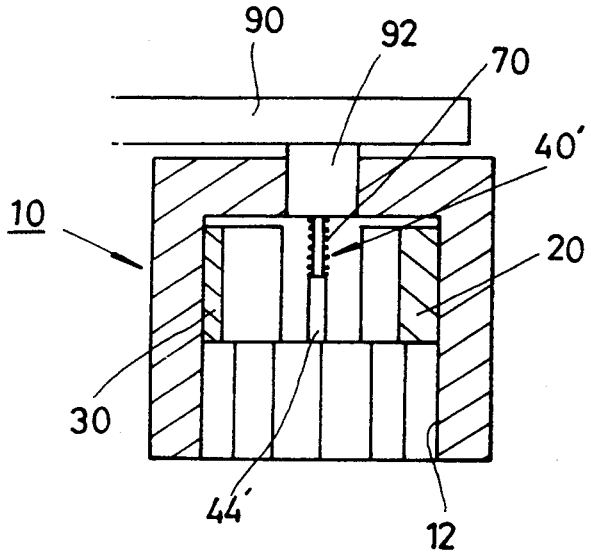
Figure 22:
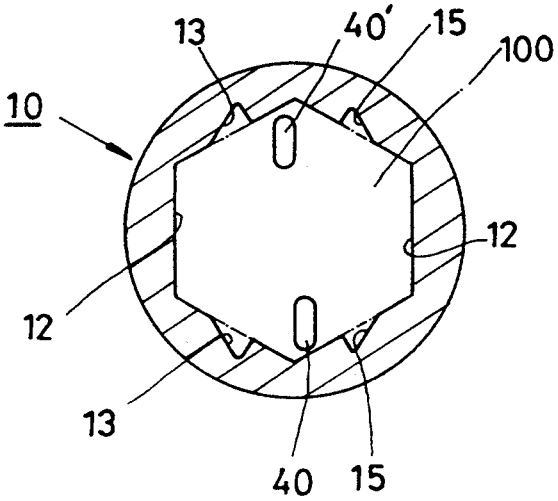

The condition of FIGS. 21 and 22 corresponds to a case where the lower adjusting portions 44 and 44' of adjusting members 40 and 40' are disposed in the gap defined between one of the side end portions 20*b* and 30*b* of the half sockets 20 and 30 and the gap defined between one of the side end portions 20*c* and 30*c* of the half sockets 20 and 30, by the adjustments of adjusting knobs 50 and 50', respectively. In this case, both the half sockets 20 and 30 can move upwards in the socket cavity 12. Accordingly, where a bolt or nut 100 with the largest size is inserted into the socket cavity 12, the half sockets 20 and 30 are upwardly lifted in the socket cavity 12 by the bolt or nut 100 being inserted, so that the bolt or nut 100 can be fitted in the socket cavity 12, to utilize the function of a socket wrench.

Figure 23:
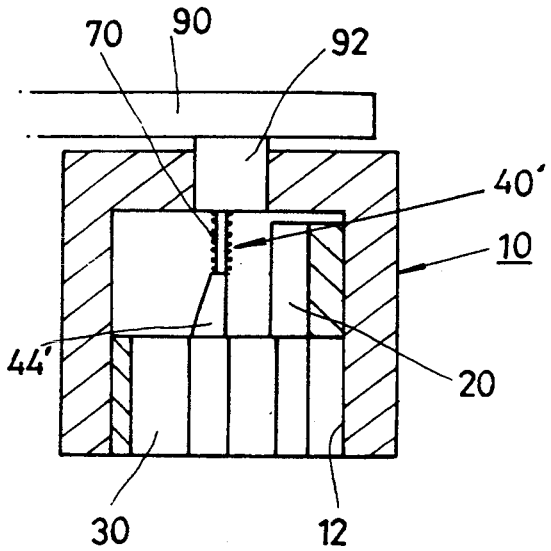
Figure 24:
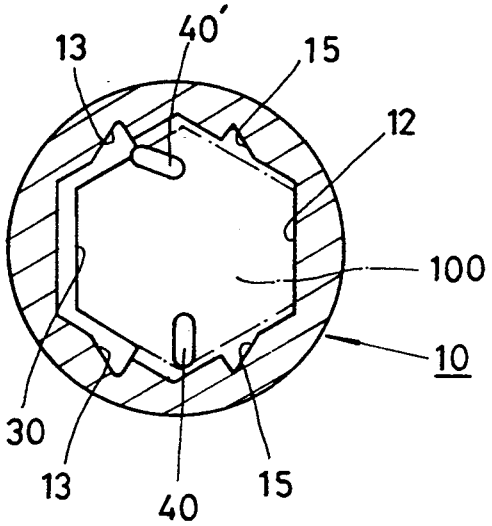
Figure 25:
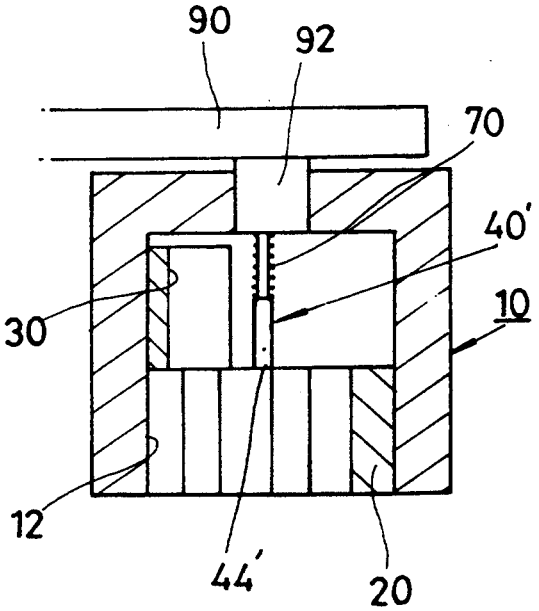

FIGS. 23 and 24 illustrate a condition that the lower adjusting portion 44' of adjusting member 40' is adjusted to be partially disposed over the half socket 30, by an adjustment of the adjusting knob 50'. In this case, only the half socket 20 can move upwards in the socket cavity 12. Accordingly, this case can be applied to a bolt or nut 100 with a size smaller than that of FIGS. 21 and 22. The bolt or nut 100 comes into contact with the inner surface of half socket 30 and the side surface portion of socket cavity 12 facing the inner surface of half socket 30, to utilize the function of a socket wrench.

Contrary to the condition of FIGS. 23 and 24, FIGS. 25 and 26 illustrate a condition that the lower adjusting portion 44 of adjusting member 40 is adjusted to be partially disposed over the half socket 20, by the adjustment of the adjusting knob 50. In this case, only the half socket 30 can move upwards in the socket cavity 12. Accordingly, this case can be applied to a bolt or nut 100 with a size smaller than that of FIGS. 23 and 24. The bolt or nut 100 comes into contact with the inner surface of half socket 30 and the side surface portion of socket cavity 12 facing the inner surface of half socket 20, to utilize the function of a socket wrench.

Figure 27:
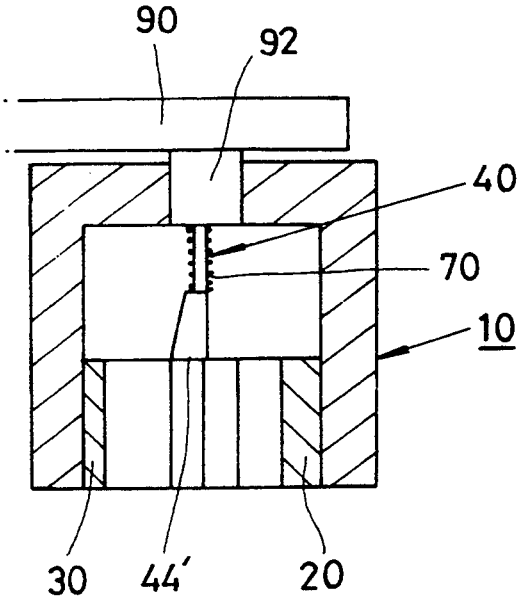
Figure 26:
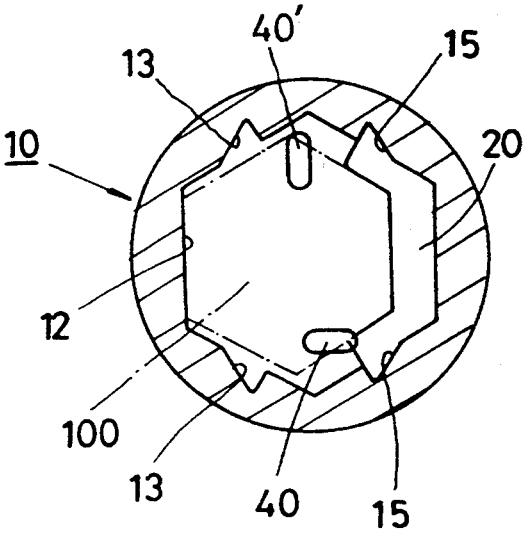
Figure 28:
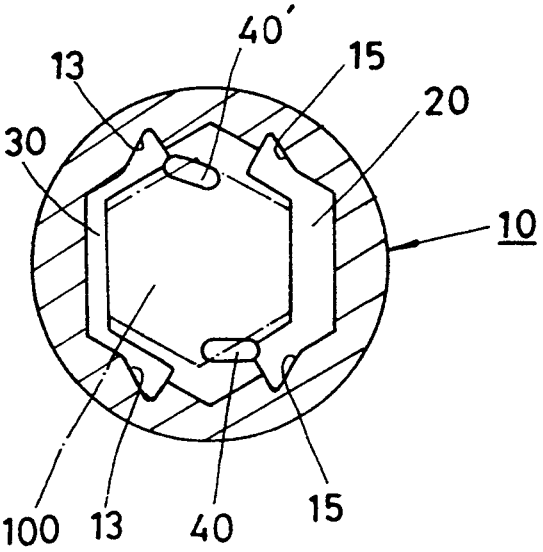

The condition of FIGS. 27 and 28 corresponds to a case where the lower adjusting portions 40 and 44' of adjusting members 40 and 40' are adjusted to be partially disposed over the half sockets 20 and 30, by the adjustments of the adjusting knobs 50 and 50', respectively. In this case, both the half sockets 20 and 30 can not move upwards in the socket cavity 12. Accordingly, this case can be applied to a bolt or nut 100 with a size smaller than that of FIGS. 25 and 26. The bolt or nut 100 comes into contact with both the inner surfaces of a half sockets 20 and 30, to utilize the function of socket wrench.

In the embodiment of FIGS. 10 to 12, the using conditions thereof are basically the same as those illustrated in FIGS. 21 to 28, except that the handle parts 422 and 422' are used, in place of the adjusting knobs 50 and 50' and thus its description will be omitted.

As apparent from the above description, the present invention provides a socket for a socket wrench comprising a socket body having a socket cavity and a pair of facing half sockets with different thicknesses slidably fitted in the socket cavity. Also, an adjusting mechanism is provided, which includes a pair of adjusting members adapted to adjust the vertical movements of the half sockets. With such a construction, the socket can be conveniently used for bolts and nuts of various sizes. Where a slide fixing member is fitted in the socket cavity, the socket body can be constructed to have arc grooves. Accordingly, it is possible to lengthen the life of a punch used for fabricating the socket body by a forging work. There is also an advantage of enabling mass production. Where adjusting members of the integral type having a handle part are used, the manufacture thereof can be easily achieved.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A socket for a socket wrench comprising:

a socket body;

a vertically extending socket cavity formed at a lower portion of said socket body;

a pair of facing half sockets each with different thicknesses fitted in said socket cavity and vertically slidable therein, wherein each of said half sockets has a central portion and a pair of opposite side end portions extending angularly from respective opposite ends of said central portion, said central portion having a thickness larger than those of said side end portions; and an adjusting mechanism provided at an upper portion of the socket body and adapted to selectively adjust the vertical slide movements of said half sockets.

2. The socket in accordance with claim 1, wherein said socket cavity includes a pair of slide grooves, and said half sockets have at their outer surfaces slide protrusions which are engaged in said slide grooves, respectively, so that the half sockets slide vertically along the slide grooves, respectively.

3. The socket in accordance with claims 1 or 2, wherein said half sockets are provided at their lower ends with notches, respectively, and said socket body is provided with a pair of stop lugs at positions where said depressions are positioned when the half sockets are coupled to the socket body, respectively, said stop lugs being engaged in the notches, respectively, so that the half sockets are prevented from separating from the socket body.

4. The socket in accordance with claim 1, wherein said socket cavity has a pair of first slide grooves and a pair of second slide grooves, and said half sockets have at their opposite side ends outer slide protrusions which are engaged in said first slide grooves and said second slide grooves, respectively, so that said outer slide protrusions of the half sockets slide vertically along the corresponding slide grooves, respectively.

5. The socket in accordance with claim 4, wherein said socket body has a pair of stop lugs at its lower surface portions where said slide grooves are positioned after fitting said half sockets in the socket cavity, so that the half sockets are prevented from separating from the socket body.

6. The socket in accordance with claim 1, wherein said socket cavity has a pair of opposite arc grooves facing each other, said socket further comprises a slide fixing member fitted in the socket cavity between said arc grooves and provided with a pair of facing slide grooves and a pair of fixing end members fitted in the arc grooves of the socket cavity and coupled to the socket body beneath said slide fixing member, and said half sockets have at their outer surfaces outer slide protrusions which are engaged in said slide grooves, respectively.

7. The socket in accordance with claim 6, wherein said slide fixing member has a pair of spaced vertical portions and a horizontal connecting portion integrally formed with said vertical portions, each of said vertical portions having an outer arc surface corresponding to each of said arc grooves of the socket cavity, an inner flat surface provided with a corresponding one of said slide grooves, and a lower taper surface.

8. The socket in accordance with claim 6, wherein each of said fixing members has an outer arc surface and an inner flat surface, an upper tapered surface engaged with each corresponding one of a lower tapered surface of the slide fixing member, and a through-hole formed at a middle portion of the fixing member and adapted to receive a fixture for fixing the fixing member to said socket body.

9. The socket in accordance with claim 1, wherein said side end portions of each half socket have different widths.

10. The socket in accordance with claim 1, wherein said socket body has a recess formed at one side portion of an upper surface of the socket body and provided with a through-hole and a plurality of index depressions, said adjusting mechanism comprises an adjusting member including an upper rod portion inserted into said through-hole of the socket body from the socket cavity such that its upper end is outwardly protruded from the through-hole, a lower adjusting portion having a lower end of a long oval shape and a step formed between said upper rod portion and said lower adjusting portion, and the adjusting mechanism further comprises a compression coil spring fitted around the upper rod portion and adapted to urge said adjusting member downward and an adjusting knob including a coupling hole for forcedly fitting said protruded upper end of the upper rod portion of the adjusting member therein and a lug formed at a lower surface of said adjusting knob and engagable in a selected one of said index depressions.

11. The socket in accordance with claim 1, wherein said socket body has a pair of recesses formed at opposite side portions of an upper surface of the socket body, each of said recesses being provided with a through-hole and a plurality of index depressions, said adjusting mechanism comprises a pair of adjusting members each including an upper rod portion inserted into said through-hole of each corresponding one of said recesses from the socket cavity such that its upper end is outwardly protruded from the through-hole, a lower adjusting portion having a lower end of a long oval shape and a step formed between said upper rod portion and said lower adjusting portion, and the adjusting mechanism further comprises a pair of compression coil springs each fitted around each corresponding upper rod portion and adapted to urge each corresponding adjusting member downward and a pair of adjusting knobs each including a coupling hole for forcedly fitting said protruded upper end of the upper rod portion of the corresponding adjusting member therein and a lug formed at a lower surface of said adjusting knob and engagable in a selected one of said corresponding index depressions.

12. The socket in accordance with claim 1, wherein said socket body has a pair of recesses formed at opposite side portions of an upper surface of the socket body, each of said recesses being provided with a through-hole and an index protrusion and said adjusting mechanism comprises a pair of adjusting members each including an upper rod portion inserted into said through-hole of each corresponding one of said recesses from the socket cavity and a lower adjusting portion having a lower end of a long oval shape and a step formed between said upper rod portion and said lower adjusting portion, said upper rod portion being provided with a pair of spaced small grooves for bending the upper rod portion such that the upper rod portion is divided into a lower coupling part partially received in the through-hole and an upper handle part outwardly protruded from the through-hole, and the adjusting mechanism further comprises a pair of compression coil springs each fitted around each corresponding upper rod portion and adapted to urge each corresponding adjusting member downward.

* * * * *